US006192525B1

(12) United States Patent
Tash

(10) Patent No.: US 6,192,525 B1
(45) Date of Patent: Feb. 27, 2001

(54) HOUSEHOLD DRAIN PLUNGER

(75) Inventor: George Tash, Somis, CA (US)

(73) Assignee: Tash Family Trust

( * ) Notice: Subject to any disclaimer, the term of this patent is extended or adjusted under 35 U.S.C. 154(b) by 0 days.

(21) Appl. No.: 09/290,349

(22) Filed: Apr. 12, 1999

(51) Int. Cl.[7] ..... E03D 11/00
(52) U.S. Cl. ..... 4/255.11
(58) Field of Search ..... 4/255.05, 255.07, 4/255.08, 255.09, 255.11, 255.12, 255.01

(56) References Cited

U.S. PATENT DOCUMENTS

| | | | |
|---|---|---|---|
| D. 46,996 | 2/1915 | Howell . | |
| D. 155,489 | 10/1949 | Mesquita | D9/2 |
| D. 159,726 | 8/1950 | Grosvold | D9/2 |
| D. 202,979 | 11/1965 | Krusche | D9/2 |
| D. 292,631 | 11/1987 | Tash | D32/14 |
| D. 364,251 | 11/1995 | Novak | D32/35 |
| D. 381,146 | 7/1997 | Tash | 8/99 |
| D. 381,147 | 7/1997 | Tash | 8/99 |
| D. 385,073 | 10/1997 | Tash | 8/99 |
| 1,180,323 | 4/1916 | Schuh . | |
| 1,852,071 | 4/1932 | Becker . | |
| 2,126,689 | 8/1938 | Pouliot | 4/255 |
| 2,195,830 | 4/1940 | Schubring | 4/255 |
| 2,473,452 | 6/1949 | Scott | 15/104.3 |
| 2,844,826 | 7/1958 | Cheiten | 4/257 |
| 3,336,604 | 8/1967 | Lacey et al. | 4/255 |
| 3,644,943 | 2/1972 | Leonardo et al. | 4/255 |
| 3,937,404 | 2/1976 | Johnson | 239/567 |
| 3,994,032 | 11/1976 | Spickofsky | 4/255 |
| 4,539,985 | 9/1985 | Magrath | 128/205.1 |
| 4,745,641 | 5/1988 | Tash | 4/255 |

*Primary Examiner*—Henry J. Recla
*Assistant Examiner*—Peter deVore
(74) *Attorney, Agent, or Firm*—Lyon, Harr & DeFrank; Mark Watson; Richard Lyon

(57) ABSTRACT

This invention relates to an improved household drain plunger for use with household drains of various shapes and sizes. The head section of the plunger is a pleated bellows consisting of a conical upper section of increasing diameter from top to bottom, and a smaller lower section, also conical, of decreasing diameter from top to bottom. A handle extends from the top of the head section. The bottom end of the plunger consists of three levels of seals depending from the bottom of the head section. The first and bottommost seal is a dual-function seal designed both to fit snugly into a typical kitchen sink drain opening, thereby providing a mechanical seal. This first seal also has a flat bottom comprising an annular ring that can be placed around a small drain hole opening, such as that in a bathroom sink or tub, to provide a pressure/suction seal with the drain opening. The annular ring has a center void which opens to the interior of the bellows. The second seal, disposed between the bellows and the top of the first seal, is designed to fit snugly into a typical garbage disposal opening, thus providing a mechanical seal with the opening. The bottommost bellows pleat comprises the third seal. This third seal forms a pressure/suction seal with the surface surrounding a drain opening, and is also dual-function, as it is used either alone or in conjunction with the second seal, depending upon the size of the drain opening.

27 Claims, 5 Drawing Sheets

HOUSEHOLD DRAIN PLUNGER

BACKGROUND OF THE INVENTION

1. Technical Field

This invention relates to an improved water and sewage drain plunger for use with household drains such as those in kitchen sinks or garbage disposals. However, the plunger of the present invention can be used equally well with a variety of sizes and shapes of drains.

2. Background Art

There are various problems associated with plunging a clogged drain. Some of these problems are related to the drain configuration, while other problems are related to the design of the plunger itself.

By way of background, drain openings such as those in sinks, tubs, and toilets are typically unclogged by using a toilet plunger comprised of a large deformable cup mounted on the end of an elongated handle or shaft. During the plunging operation, the plunger cup is held over the mouth of the drain while the plunger handle is reciprocated in an upward and downward motion that alternately contracts and enlarges the space within the cup. Preferred plunging action creates an alternating pressure and suction force in the drain passage that is often sufficient to dislodge an obstruction.

A common problem associated with use of existing plunger devices in typical drain openings of various sizes and shapes is the tendency of the bottom end of the plunger cap to slide about over the surface surrounding the drain opening being cleared. As a result, splashing and/or spillage of standing wastewater from within the basin above the drain are common. Further, the suction force applied by the plunger is often reduced or eliminated by such slippage. Another problem associated with conventional plunger devices is the limited volume of the plunger cap. This small volume limits the amount of pressure and suction that may be applied to a drain obstruction. Consequently, conventional plungers are often unable to provide sufficient pressure or suction for the purpose of dislodging the obstruction which is blocking the drain. Another problem typically seen with these cup-type plungers is the tendency for wastewater to spray out with great force from between the plunger cup and the surface surrounding the drain opening. The wastewater then often splashes up and outside of the basin surrounding the drain and onto the operator and nearby walls and floors. This phenomenon is called "splash back."

Therefore, in order to overcome the limitations of prior plunger devices, what is needed is a plunger that will seat securely in or around a drain opening to avoid the problems of splashing and spillage of wastewater, and of reduction in suction force. Further, the plunger should have a large volume that smoothly and slowly compresses to a relatively small volume during use. This feature serves the dual purpose of providing the maximum possible pressure and suction force to an obstructed drain while avoiding splash back. Finally, such a plunger should be simple, capable of being easily fabricated and used, and should be inexpensive and durable.

SUMMARY

The drain plunger of the present invention satisfies all of the foregoing needs. The plunger is adapted for use with a wide variety of sizes and shapes of drain openings such as are common in sinks, tubs, and toilets. The design of the plunger embodied in the present invention is such that the problems of slippage, splashing, spillage and splash back are lessened. Furthermore, the plunger can be easily and inexpensively molded, preferably of durable rubber or plastic. The plunger is also lightweight and easy to use.

The plunger of the present invention consists of an elongated handle attached to the upper end of a "head" section, and a seal section which is attached to the lower end of the head section. The handle can be either permanently or releasable attached to the head section. The head section of the plunger is a pleated bellows consisting of two sections, an upper section which is conical and of increasing diameter from top to bottom, and a smaller lower section, also conical, and of decreasing diameter from top to bottom which depends from the bottom of the upper section. The bottom end of the plunger consists of two levels of seals which depend from the bottom of the lower section of the bellows. The first and bottommost seal is designed to fit snugly into a typical kitchen sink drain opening. This first seal will provide a mechanical seal with the kitchen sink drain hole being cleared by the plunger. Further, the first seal is also designed to be placed around a small drain hole opening such as is typically seen in a bathroom sink or tub to provide a pressure/suction seal with the drain opening. The first seal is of a bulbous ring configuration, the bottom of which is an annular flat ring defining a central void which is open to the bellows. The aforementioned second seal is disposed between the bellows and the top of the first seal, and has a slightly tapered short cylindrical wall that is larger in diameter than the first seal. This second seal is designed to fit snugly into a typical garbage disposal opening and will provide a mechanical seal with that opening. In addition, the bottommost pleat of the bellows forms a third seal which is designed to form a pressure/suction seal with the surface surrounding a drain opening. This third seal is useful when it is necessary to clear an obstruction from a drain which is larger diameter than a typical garbage disposal opening.

As pressure is applied downward on the handle, the bellows compresses and the portion of the seal in contact with the drain opening forms a mechanical and/or a pressure/suction seal with the surface surrounding the drain opening. As a result, the pressure generated by the compression of the bellows is directed through the sealing structures and into the drain in the direction of the obstruction. As the handle is then pulled upwards, a suction force is applied to the obstruction in the drain. The obstruction can thus be effectively dislodged.

DESCRIPTION OF THE DRAWINGS

FIG. 1A further shows the drain plunger with a threaded stud on top of the head for securing a releasably attached handle.

DETAILED DESCRIPTION OF THE PREFERRED EMBODIMENTS

In the following description of the preferred embodiments of the present invention, reference is made to the accompanying drawings, which form a part hereof, and which are shown by way of illustration of specific embodiments in which the invention may be practiced. It is understood that other embodiments may be utilized and structural changes may be made without departing from the present scope of the invention.

For the purpose of this disclosure, the term "pressure seal" will mean a pressure and suction or vacuum seal. As described below, the pressure seal is in effect when the plunger is being compressed, and the suction or vacuum seal is in effect when the plunger is being expanded.

Figure 1A:
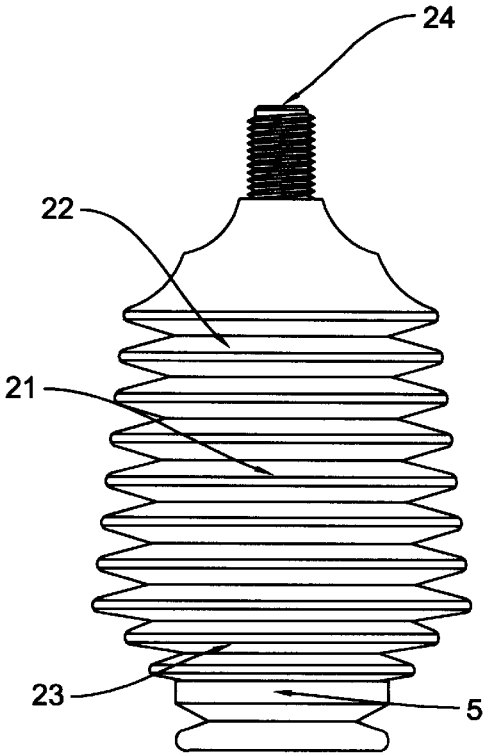
FIG. 1A is a schematic side elevation of a drain plunger according to the present invention shown in a standing resting condition.
Figure 1B:
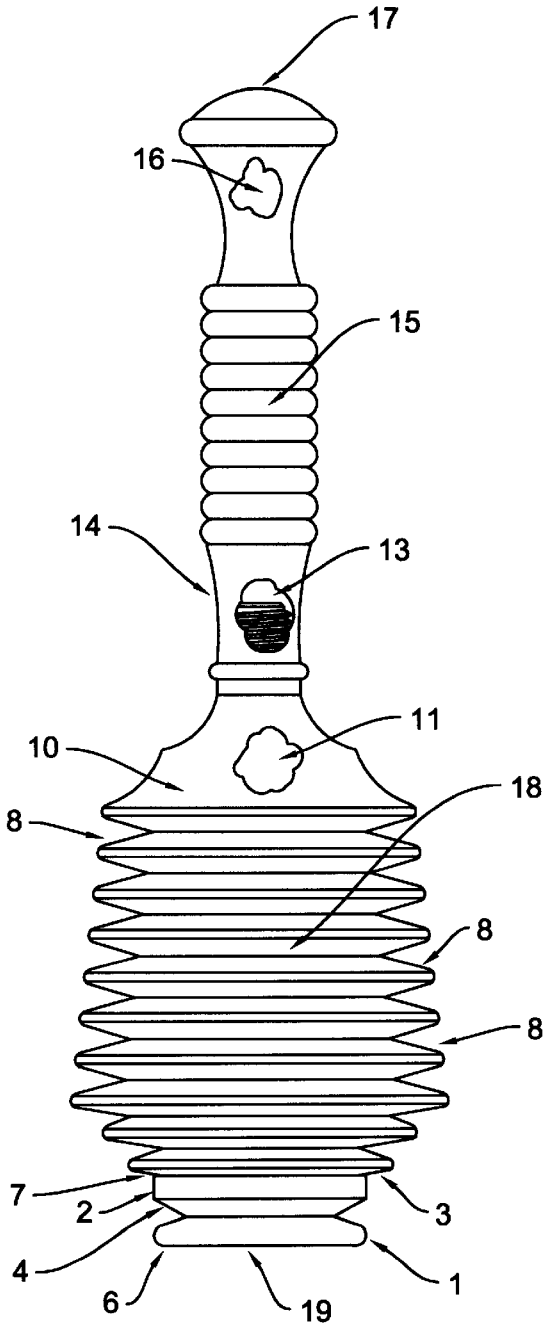
FIG. 1B is a schematic side elevation, partly broken away, with the drain plunger of FIG. 1A shown in a standing resting condition.

The plunger 10 of the present invention has an elongated handle 15, a head section 21, and a seal section 5 (FIGS. 1A and 1B). The head 21 and seal 5 sections are preferably made from durable flexible rubber or plastic material, preferably a blow molded material. The handle 15 can be made from the same material as the head 21 and seal 5 section, or may be made from other materials such as, for example, wood, ceramic, or metal. The handle 15 is preferably threadably connected 13 to the head 21. However, the handle 15 may be releasably or permanently attached to the head 21 by other methods such as, for example, an integrally molded handle, a handle permanently glued or riveted to the head, or a handle releasably connected to the head via a snap-fit mechanism or cotter pin. In the threaded embodiment, the head 21 has a threaded stud 24 extended from its top end. The handle 15 is preferably hollow at end 14 with threads 13 formed on its inner surface to receive the head's threaded stud. Preferably, the remainder of handle 15 is also hollow, whether permanently or releasably attached, having a central space 16 therein to reduce its weight. The upper end of the handle 15 is formed into an expanded knob 17 adapted to comfortably rest in the operators' palm when using the plunger.

Figure 2:
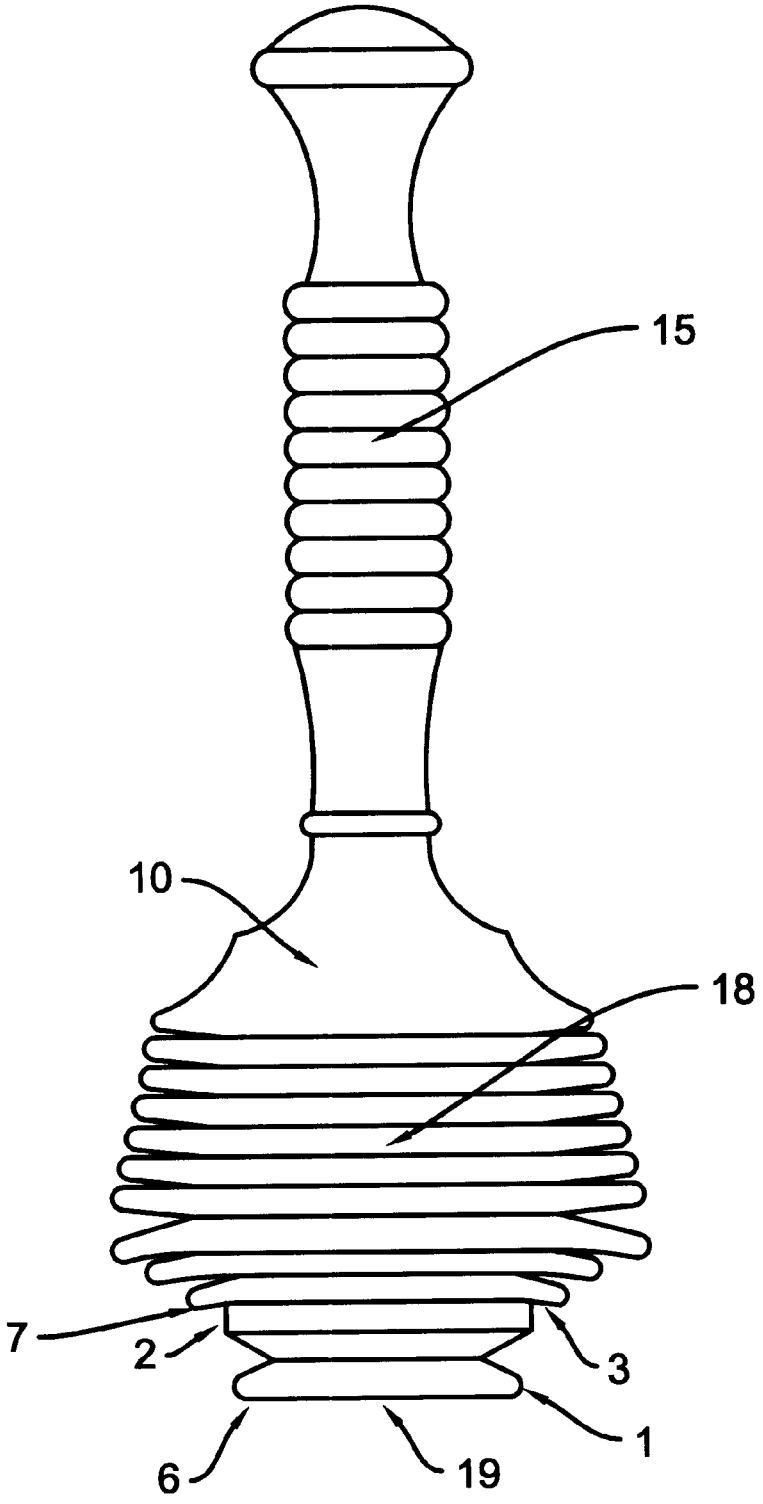
FIG. 2 is a schematic side elevation of the plunger of FIG. 1A shown with the plunger bellows fully compressed as occurs when the plunger is in use.

The head section 21 of the plunger 10 is a pleated bellows 18 consisting of an upper section 22 which is conical and of increasing diameter from top to bottom, and a smaller lower section 23 depending from the bottom of the upper section. The lower section 23 is also conical, and of decreasing diameter from top to bottom. The bellows 18 has a central space 11 which forms the internal volume of the bellows. This volume is substantially larger than that of typical cup-type plungers. Further, because the pleats 8 forming the bellows 18 are of preferably progressively greater flexibility from the top to the bottom of the bellows, the pleats easily and smoothly compress and nest together into a relatively small volume during use of the plunger (FIG. 2). The ability of the plunger to smoothly compress and nest avoids the sudden rush of pressurized air common to the sudden collapse of the cup of a standard plunger which often causes the splash back problem described previously.

The seal section 5 depends from the bottom of the lower section 23 of the bellows 18. The seal section 5 is comprised of a first seal 1 and a second seal 2. These seals are relatively stiffer than the bellows 18. The seals can be formed of the same materials as the bellows 18, but of relatively different proportions of those materials than for the bellows so as to control their flexibility.

Figure 4:
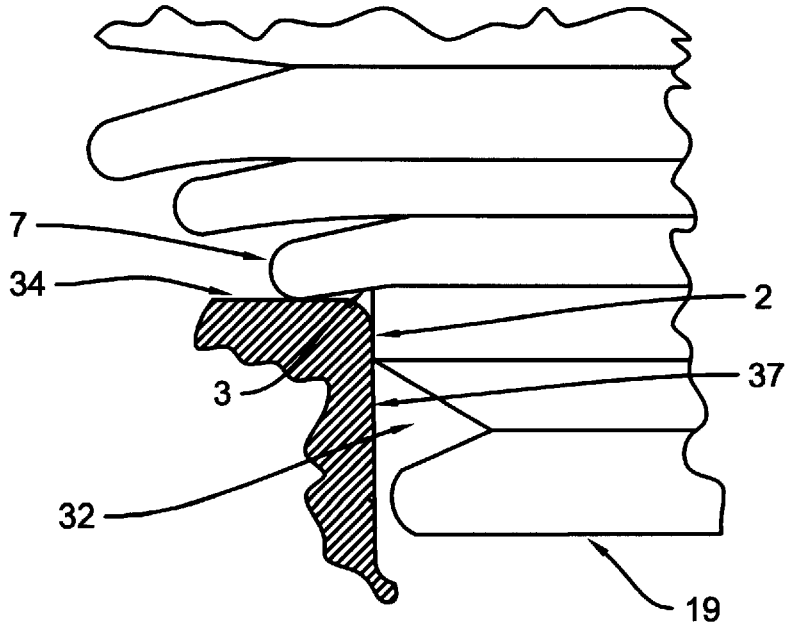
FIG. 4 is an enlarged, fragmentary, schematic side elevation, partly in cross-section, showing the plunger of FIG. 1A with a second seal in sealing contact with the drain opening in a standard garbage disposal opening.
Figure 6:
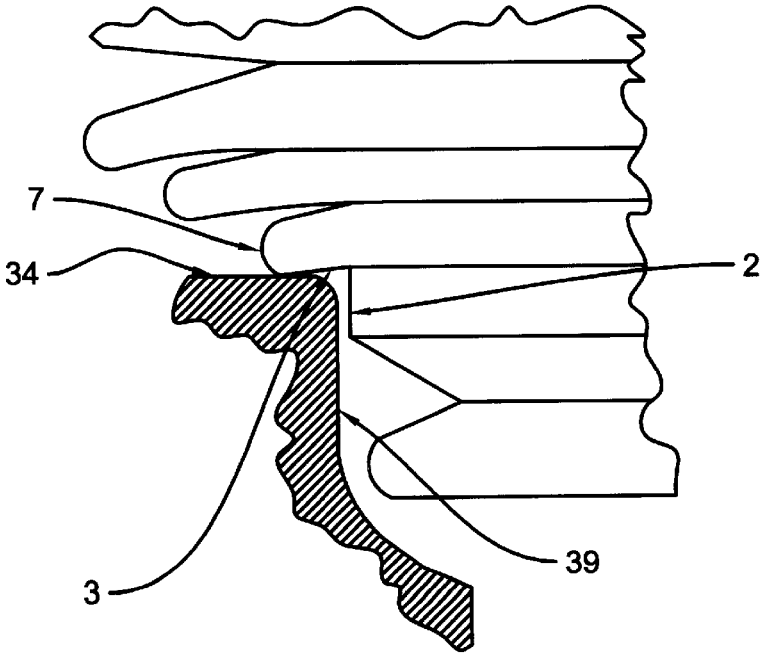
FIG. 6 is an enlarged, fragmentary, schematic side elevation, partly in cross-section, of the drain plunger of FIG. 1A with a third seal in sealing contact with a drain opening which is larger than that in a standard garbage disposal opening.

The second seal 2 is a short, slightly tapering, cylindrical wall, slightly larger in diameter than a garbage disposal opening 32 (FIG. 4). The second seal 2 depends from the bottommost bellows pleat 3, this bottommost pleat also forms a third seal 7. The second seal 2 is relatively less flexible than the pleats 8, but is sufficiently flexible to deform inwardly when the plunger is inserted into a standard garbage disposal opening 32 (FIG. 4). The deformation of the second seal 2 thus creates an interference fit/mechanical seal between the second seal and the vertical wall 37 which defines a standard garbage disposal opening 32. Further, the bottommost pleat 3 prevents the plunger from proceeding too far into the drain opening by resting on the surface 34 surrounding the drain opening. In addition, because the outer edge of the bottommost pleat deforms downwardly when the plunger is compressed, the lower surface of this pleat forms an upwardly and inwardly curved external sealing surface (FIGS. 4 and 6), thereby forming the third seal 7. In operation, this third seal 7 is active in two cases. First, in the aforementioned case when the second seal 2 is used to create an interference fit and mechanical seal with a standard garbage disposal opening 32 (FIG. 4), the third seal 7 enhances this plunger/drain interface by additionally forming a pressure seal with the surface surrounding the drain opening. This pressure seal is produced when the plunger is compressed thereby forcing air out from within a volume defined by the external sealing surface of the third seal 7 and the surface surrounding the drain opening. Second, when the drain opening being cleared is larger than a typical garbage disposal opening (FIG. 6), the third seal 7 acts alone to form a pressure seal with the surface surrounding the drain opening 39. Further, in this second case, the second seal 2, being disposed within the drain opening 39 serves to limit or prevent lateral slippage that can cause splashing and spillage of wastewater.

Figure 3:
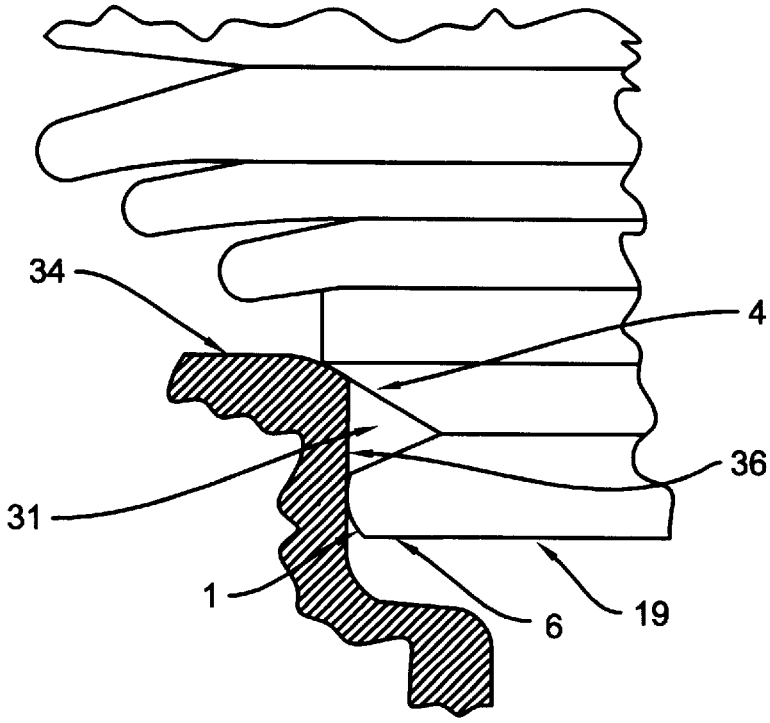
FIG. 3 is an enlarged, fragmentary, schematic side elevation, partly in cross-section, showing the plunger of FIG. 1A with a first seal in sealing contact with the drain opening in a standard kitchen sink.

A cone shaped wall 4, decreasing in diameter from the top to the bottom, depends from the bottom of the second seal 2 to provide a point of connection for the upper end of the first seal 1 (FIG. 3). The first seal 1 has a bulbous ring shape, is relatively short in height and smaller in diameter than the second seal, but is slightly larger in diameter than a standard kitchen sink drain opening 31. The first seal 1 is similar in flexibility to the second seal 2; thus it is sufficiently flexible to deform inwardly when the plunger is inserted into a standard kitchen sink drain opening (FIG. 3). The deformation of the first seal 1 thus creates an interference fit/mechanical seal between the first seal and the vertical wall 36 which defines a standard kitchen sink drain opening 31. Further, wall 4 prevents the plunger from proceeding too far into the drain opening (FIG. 3) by resting on the surface 34 surrounding the drain opening.

Figure 5:
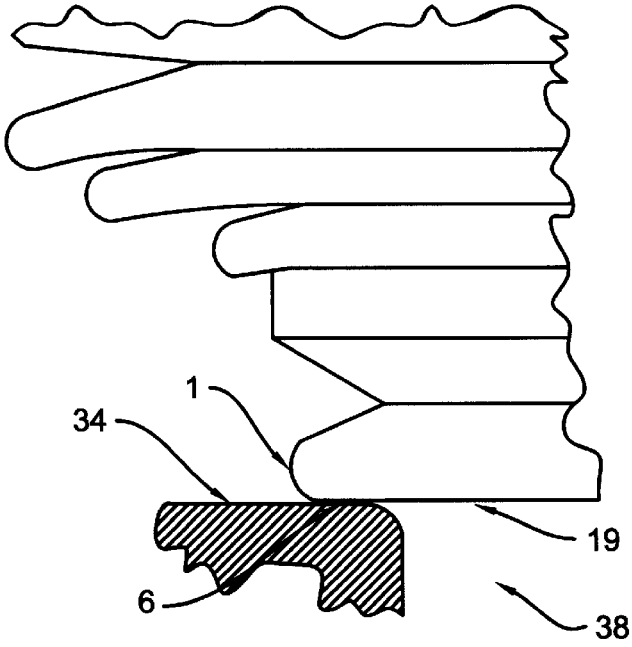
FIG. 5 is an enlarged, fragmentary, schematic side elevation, partly in cross-section, of the drain plunger of FIG. 1A in sealing contact with a drain opening which is smaller than that in a standard kitchen sink.

The first seal 1 has a flat bottom end 6, which enables the plunger to rest in the upright position of FIGS. 1A and 1 B. Further, the bottom end 6 of the first seal 1 is a flat annular ring having a central void 19 which opens through the aforementioned second seal 2 and into the central space 11 of the bellows 18 to allow air/fluid flow from the bellows into the drain opening when the plunger is compressed. The flat annular ring of the first seal 1 is adapted to abut the surface 34 surrounding a drain hole 38 which is smaller than that of a standard kitchen sink, as shown in FIG. 5, in order to form a pressure seal around the drain hole. This pressure seal is accomplished by partially compressing the bellows 18 before placing the flat bottom end of the first seal 1 flush with the surface surrounding the drain hole. After placing the partially compressed plunger in an upright position over the drain hole with the end of the first seal 1 abutting that surface, a pressure seal is formed that keeps the plunger from pulling away from the surface surrounding the drain hole as the plunger is used to clear that drain.

The aforementioned mechanical seal between the first 1 or second seal 2 and the drain wall is formed as pressure is applied downward on the handle 15, compressing the bellows 18 and driving the first seal and/or the second seal into the appropriate opening. The aforementioned pressure seals between the first 1 or third seal 7 and the surface surrounding the drain opening is again formed as pressure is applied downward on the handle 15, partially compressing the bellows 18 to expel air from the bellows, then placing the seal in contact with the surface surrounding a drain opening. The air pressure generated by compression of the bellows 18 forces pressurized air and wastewater into the drain towards the obstruction. As the handle 15 is then pulled upwards, the bellows 18 expands and creates a suction force in the drain, pulling the obstruction upwards, and preventing the plunger from lifting away from the drain. Because of the tight fit between the first or second seal and the wall defining the drain opening, there is no loss of pressure or suction from this interface. Alternating between pushing and pulling the handle 15 creates a strong reciprocating pressure/suction force in the drain that is generally sufficient to quickly clear any obstruction. The expanded volume of the bellows 18 of the present plunger in relation to typical plungers creates greater pressure and suction forces. Further, the mechanical seal provided by the first seal 1 or the second seal 2 keeps the plunger in place and prevents the lateral slippage that can cause splashing and spillage of wastewater.

Figure 7A:
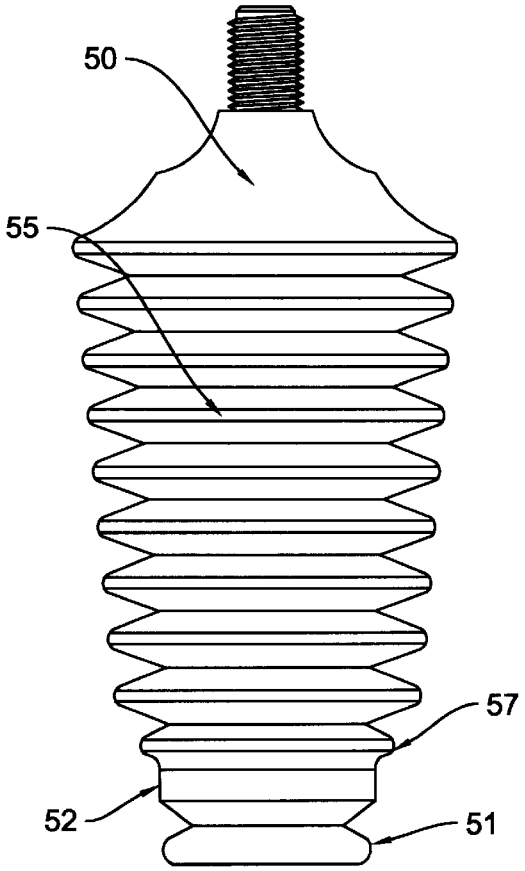
FIG. 7A is a schematic side elevation of an alternate embodiment of a drain plunger according to the present invention shown in a standing resting condition.
Figure 7B:
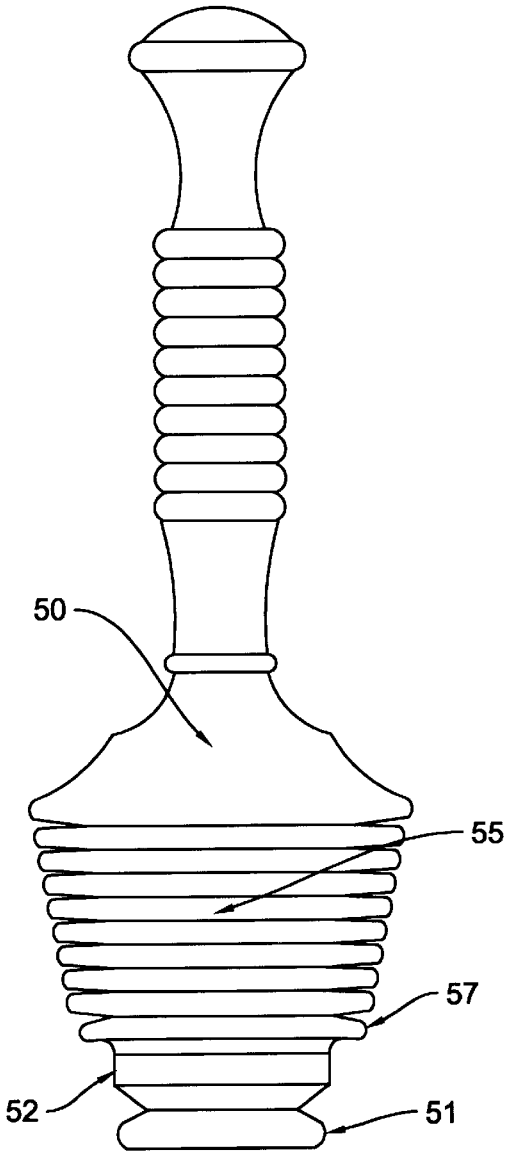
FIG. 7B is a schematic side elevation of the plunger of FIG. 7A shown with the plunger bellows fully compressed as occurs when the plunger is in use.

In an alternate embodiment of a plunger according to the present invention (FIGS. 7A and 7B), the shape of the bellows may be modified to better accommodate different sizes and shapes of sinks or basins above a drain opening. For example, the plunger 50 shown in FIGS. 7A and 7B has a conical pleated bellows 55 which, unlike the plunger of the previous embodiment, is of decreasing diameter from top to bottom. This plunger 50 is both longer and narrower in diameter than the plunger of the previous embodiment. Consequently, this alternate embodiment is better suited for use in smaller sinks and basins, such as are typically found in household bathrooms, than are the previous embodiments. However, because a first, second and third seal, 51, 52 and 57, of the alternate embodiment, operate like the aforementioned first, second and third seals, 1, 2 and 7, respectively, of the previous embodiment, the alternate embodiment can be used equally well with any of the drain configurations described above. Further, because the size, shape and arrangement of the plunger seals are the determining factors in interfacing with drain openings, the shape of the bellows is of secondary concern. So long as the bellows has sufficient volume to produce a satisfactory pressure and suction force when compressed and expanded, the shape of the bellows may be varied for aesthetic reasons without affecting it's performance, usability or durability. For example, the bellows may comprise such shapes as a sphere, an oval, a cone, a pyramid, or it may have a rectangular cross-section. The bellows may also have a shape which is any combination of these shapes. Further, the bellows may also comprise fanciful shapes, or any other practical shape which is pleasing.

The household drain plunger embodied in the present invention has many advantages. The first seal 1 is a dual function seal designed both to fit snugly into standard kitchen sink drain openings and to fit around the opening of smaller drains. The second seal 2 is designed to fit snugly into standard garbage disposal openings. The third seal 7 is also a dual function seal. This third seal 7 is designed to be used in conjunction with the second seal 2, and as a stand-alone seal when used with drain openings of larger diameters than those found in a typical garbage disposal openings. In combination or separately, these three seals are ideally adapted to provide a mechanical and/or a pressure seal that is superior to that provided by other plunger type devices. Further, the mechanical seal eliminates lateral slippage that can cause splashing and spillage of wastewater. Consequently, this superior sealing ability allows an enhanced reciprocating pressure and suction force that is directed to the material causing the clogged drain, thereby rapidly and efficiently clearing the obstruction. Further, the design of the first seal 1 provides an additional flexibility in adapting the plunger to various smaller sizes and shapes of drain openings that is not available with other plunger devices. Finally, the design of the bellows 18, which allows the pleats 8 to easily and smoothly nest, avoids the sudden rush of pressurized air common to the sudden collapse of a standard plunger which often causes the aforementioned splash back problem.

While the invention has been described in detail by specific reference to preferred embodiments thereof, it is understood that variations and modifications thereof may be made without departing from the true spirit and scope of the invention. For example, this invention can also be employed for use with a wide variety of sizes and shapes of drain openings including those found in toilets.

Wherefore, having thus described the present invention, what is claimed is:

1. A plunger comprising:

a handle, a head connected to said handle comprising a pleated bellows, a sealing structure connected to the bottom of said head section, said sealing structure having at least two seals, each seal having a larger diameter than the previous seal from bottom to top for mechanically sealing variously sized drain openings by forming an interference fit with walls defining such drain openings and wherein a bottommost pleat of the pleated bellows comprises a third seal for forming a pressure seal with a surface surrounding a drain opening.

2. The plunger of claim 1 wherein said sealing structure comprises a first seal and a second seal.

3. The plunger of claim 2 wherein the first seal has a flat bottom end comprising an annular ring defining a central void which opens to the interior of said pleated bellows.

4. The plunger of claim 3 wherein the flat bottom end of the first seal allows the plunger to rest in a standing position.

5. The plunger of claim 3 wherein the first seal is a dual function seal and wherein the flat bottom end of the first seal is capable of forming a pressure seal with a surface surrounding a drain opening.

6. The plunger of claim 2 wherein said first seal is slightly larger in diameter than a standard kitchen sink drain opening, and wherein the first seal depends from the bottom of said second seal.

7. The plunger of claim 6 wherein the first seal is sufficiently flexible to deform inwardly when inserted into a standard kitchen sink drain opening in order to form an interference fit, thus producing a mechanical seal with a wall defining the drain opening.

8. The plunger of claim 6 wherein said first seal has a bulbous ring shape.

9. The plunger of claim 2 wherein said second seal is slightly larger in diameter than a standard kitchen garbage disposal opening.

10. The plunger of claim 9 wherein the second seal is sufficiently flexible to deform inwardly when inserted into a standard kitchen garbage disposal opening in order to form an interference fit, thus producing a mechanical seal with a wall defining the garbage disposal opening.

11. The plunger of claim 10 wherein the bottommost pleat of the head is sufficiently large in diameter to stop said second seal from proceeding too far into a garbage disposal opening.

12. The plunger of claim 9 wherein said second seal has a slightly tapering cylindrical wall.

13. The plunger of claim 2 wherein a tapering conical wall is disposed between said second seal and said first seal.

14. The plunger of claim 13 wherein said tapering conical wall is sufficiently large in diameter to stop said first seal from proceeding too far into a kitchen sink drain opening.

15. The plunger of claim 2 wherein the first, second and third seals are of progressively greater diameter from the first to the third seal.

16. The plunger of claim 1 wherein the third seal is capable of forming a pressure seal simultaneously with a mechanical seal formed between the second seal and a vertical wall defining a garbage disposal opening.

17. The plunger of claim 1 wherein the head section is formed of flexible resilient plastic.

18. The plunger of claim 1 wherein said handle is detachable from said head.

19. The plunger of claim 1 wherein said handle is integral with said head.

20. The plunger of claim 1 wherein said pleated bellows is more flexible than the sealing structure.

21. The plunger of claim 1 wherein said pleats nest together when said bellows is compressed.

22. The plunger of claim 1 wherein:

said pleated bellows has a first conical section and a second conical section, and wherein said first conical section of the head has a smaller diameter at the top of the head, and increases in diameter in a direction towards the bottom of the head, and said second conical section of the head depends from the bottom of said first conical section and decreases in diameter in a direction towards the bottom of the head.

23. A plunger comprising:

a dual function seal having a flat bottom end capable of forming a pressure seal with a surface surrounding a drain opening, the dual function seal also having a bulbous ring shape which is capable of fitting snugly into a first drain opening to form a mechanical seal with the first drain opening;

a second seal, the bottom of the second seal attached to the top of the dual function seal, wherein the second seal is capable of fitting snugly into a second drain opening, larger in diameter than the first drain opening, to form a mechanical seal with the second drain opening; and a third seal, the bottom of the third seal attached to the top of the second seal, wherein the third seal is capable of forming a pressure seal with a surface surrounding a drain opening which is at least as large as the second drain opening.

24. The plunger of claim 23 wherein the third seal is capable of forming the pressure seal simultaneously with the mechanical seal formed by the second seal.

25. A plunger comprising:

a handle, a head connected to said handle comprising a pleated bellows, and a sealing structure connected to the bottom of said head section, said sealing structure comprising a first seal and a second seal, each seal having a larger diameter than the previous seal from bottom to top for mechanically sealing variously sized drain openings by forming an interference fit with walls defining such drain openings;

wherein the second seal is slightly larger in diameter than a standard kitchen garbage disposal opening; and wherein the second seal is sufficiently flexible to deform inwardly when inserted into a standard kitchen garbage disposal opening in order to form an interference fit, thus producing a mechanical seal with a wall defining the garbage disposal opening.

26. The plunger of claim 25 wherein the bottommost pleat of the head is sufficiently large in diameter to stop said second seal from proceeding too far into a garbage disposal opening.

27. The plunger of claim 25 wherein the bottommost pleat of the head comprises a third seal capable of forming a pressure seal with a surface surrounding a drain opening simultaneously with a mechanical seal formed between the second seal and a vertical wall defining a garbage disposal opening.

* * * * *